United States Patent [19]

van Bergen

[11] 4,187,696

[45] Feb. 12, 1980

[54] EAR ORNAMENT CLIPS

[76] Inventor: Johannes A. W. P. van Bergen, Stollenbergweg 156, Berg en Dal, Netherlands

[21] Appl. No.: 854,635

[22] Filed: Nov. 25, 1977

Related U.S. Application Data

[63] Continuation-in-part of Ser. No. 849,044, Nov. 7, 1977, which is a continuation of Ser. No. 724,970, Sep. 20, 1976, abandoned.

[30] Foreign Application Priority Data

Oct. 1, 1975 [GB] United Kingdom ..... 40113/75

[51] Int. Cl.[2] ..... A44B 21/00

[52] U.S. Cl. ..... 63/14 C

[58] Field of Search ..... 24/252; 63/14 R, 14 A, 63/14 B, 14 C, 14 D, 14 E, 14 F

[56] References Cited

U.S. PATENT DOCUMENTS 3,533,247 10/1970 Douglas ..... 63/14 D 3,654,774 4/1972 van Bergen ..... 63/14 C

FOREIGN PATENT DOCUMENTS 711880 6/1965 Canada ..... 63/14 C 867883 4/1971 Canada ..... 63/14 C

*Primary Examiner*—F. Barry Shay

*Attorney, Agent, or Firm*—Irving M. Weiner; Pamela S. Burt

[57] ABSTRACT

A two-part ear ornament clip including front and back parts which are pivotally connected together. The front and back parts are so dimensioned and connected together that, in the open condition of the clip, handling and application of the clip by the wearer to her ear lobe is greatly facilitated. The front and back parts, when disposed in their ear lobe gripping positions relative to each other, are such that the portion of the front part to which an ornament would be secured is directly opposite the portion of the back part which is in contact with the inside face of the ear lobe.

5 Claims, 8 Drawing Figures

EAR ORNAMENT CLIPS

The present application is a continuation-in-part of copending U.S. patent application Ser. No. 849,044 filed on Nov. 7, 1977 and entitled "EAR ORNAMENT CLIPS," which in turn is a continuation of U.S. patent application Ser. No. 724,970 filed on Sept. 20, 1976 and entitled "EAR ORNAMENT CLIPS", now abandoned.

BACKGROUND OF THE INVENTION

The present invention relates to ear ornament clips which include front and back parts which are so dimensioned and connected together as to provide greater ease in handling and application than prior ear ornament clip constructions.

An ear ornament clip construction is disclosed in United Kingdom Patent Specification No. 976,341, and the form in which the ear ornament clip disclosed therein has been marketed for more than ten years is illustrated in FIGS. 7 and 8 of the accompanying drawings.

FIG. 7 of the drawings illustrates a first clip member 10 (hereinafter called the front part) and a second clip member 11 (hereinafter called the back part) which are pivotally connected together at 12, the back part being in the position which it is able to occupy, and will in practice occupy, when the two parts have been separated to release the ear lobe. This condition of the clip, and indeed of any ear ornament clip, will be hereinafter referred to as the fully open condition. It will be appreciated that for a woman to apply the clip and the ornament carried thereby to her ear lobe, it will be necessary for her to put, for instance, her index finger in contact with the front surface of ornament 13 and the tip of her thumb in contact with the surface 14 of the back part 11. However, instead of being able to simply squeeze the front part 10 and the back part 11 towards each other, she must first push the back part upwardly about pivotal axis 12 relative to front part 10 in order to bring that back part into the position thereof which is illustrated in FIG. 8 of the accompanying drawings.

In practice, this necessity proves to be a complication from the woman's point of view because the ear ornament clip is extremely small and its smallness makes it very easy for a woman to inadvertently drop the clip in the course of trying to apply it to an ear lobe. In fact, the smaller the ornament 13 is, the more difficult is the task of application of the clip to the ear lobe. If the ornament were circular and of the diameter shown in FIG. 8 in full line, it would be relatively easy for the tip of the index finger and the ball of the thumb to exert a clip-closing force along, i.e., the line A—A shown in FIG. 8 whereas, if the ornament (for example, a small pearl) were to be of the size shown in dotted line in FIG. 8, the ability of the woman to exert pressure along line A—A without either the index finger or the thumb slipping off would diminish very considerably because the index finger would have much less area of ornament to which to apply the force. In fact, in experiments which have been conducted, particularly when the ornament carried by the front part 10 is quite small, it has been found that (with the front and back parts in the FIG. 8 positions) the index finger and thumb sometimes exert the force along line B—B because the thumb is not actually far enough along the back part 11 towards the curved end part 15 thereof. Discovery of this problem necessitates re-positioning of the clip carefully between the tips of the index finger and thumb and even then the closure of the clip to the lobe-gripping condition thereof can be quite a slow process.

SUMMARY OF THE INVENTION

The principal object of the present invention is to provide a clip construction in which the above-discussed drawbacks are completely overcome, or at least significantly reduced.

To this end, the present invention provides an ear ornament clip which includes a front part and a back part, with the front and back parts being so connected to one another as to permit angular movement of the parts relative to each other in order to grip or release a wearer's ear lobe. The front part has a first portion of which one face is adapted to carry the ornament and of which the other face is adapted to be placed in contact with that surface of the wearer's ear lobe against which the ornament is to be displayed. The front part also has a second portion integral with the first portion and including elements which are so joined to one another at corresponding one ends thereof as to form resilient elements substantially in the form of a modified V or spread U, the corresponding other and free ends of the elements extending substantially parallel to the first portion of the front part. The back part has a first portion which includes a face of which at least a portion thereof is adapted to be placed in contact with that surface of the wearer's ear lobe which is remote from the surface thereof against which the ornament is to be displayed, and the back part further has a second portion which is integral with the first portion thereof and which comprises substantially parallel legs. The front part has first means disposed near the resilient elements and the back part has second means disposed near the free ends of the legs, the first and second means cooperating to form a pivotal connection between the front and back parts. Relative angular movement of the front and back parts to a condition in which an ear lobe becomes gripped between the first portion of the front part and the first portion of the back part not only causes the lobe-gripping portions of the front and back parts of the clip to become disposed substantially directly opposite to each other, but also causes the inside surfaces of the legs to frictionally slide along the outside surfaces of the resilient elements towards the free ends of the resilient elements and to force the resilient elements together to establish and maintain the desired lobe-gripping condition of the front and back parts.

In the preferred embodiment, the first portion of the back part of the clip is substantially U-shaped with diverging legs, the first diverging leg having a free end, and the second diverging leg being integral with the second portion of the back part. The free end of the first diverging leg comprises the lobe contacting portion of the first portion of the back part of the clip.

Other objects and details of the invention will become apparent from the following description, when read in conjunction with the accompanying drawings.

DETAILED DESCRIPTION OF PREFERRED EMBODIMENTS

There is hereby incorporated by reference thereto the entire disclosure of the aforementioned U.S. patent application Ser. No. 724,970 filed on Sept. 20, 1976 and U.S. patent application Ser. No. 849,044 filed on Nov. 7, 1977.

Figure 5:
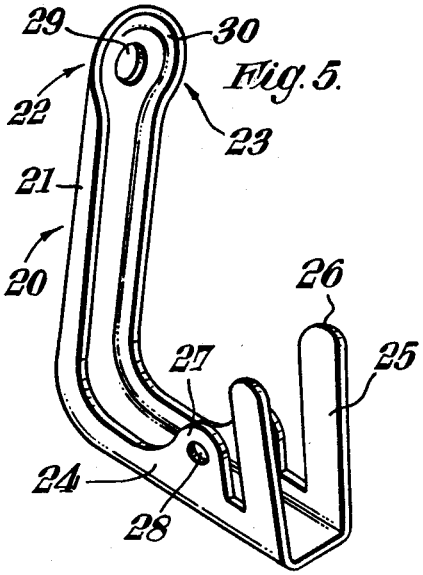
FIG. 5 depicts a perspective view of the front part of an ear ornament clip in accordance with the invention.

With reference to FIG. 5, there is illustrated a front part 20 of the two-part ear ornament clip according to the invention. The front part 20 has a first portion 21 of which one face 22 is adapted to carry the ornament (not illustrated) and of which the other face 23 is adapted to be placed in contact with that surface of the lobe of the wearer's ear against which the ornament is to be displayed. The front part 20 also has a second portion 24 which is integral with the first portion 21 and which includes elements 25 which are so joined to one another at corresponding one ends thereof as to form resilient elements substantially in the form of a V having a flattened lower portion, the corresponding other and free ends 26 of the resilient elements 25 extending substantially parallel to the first portion 21 of front part 20.

As shown in FIG. 5, the two divergent elements 25 are substantially identical. Located near the resilient elements 25 are two lugs 27, in which coaxial apertures 28 are formed, one of the lugs 27 and the aperture 28 being partially hidden from view behind one of the resilient elements 25 in FIG. 5. The first portion 21 has an aperture 29 in the enlarged free end 30 thereof, the end 30 and aperture 29 being provided for support and attachment of certain kinds of ornaments, discussed more fully hereinbelow.

Figure 6:
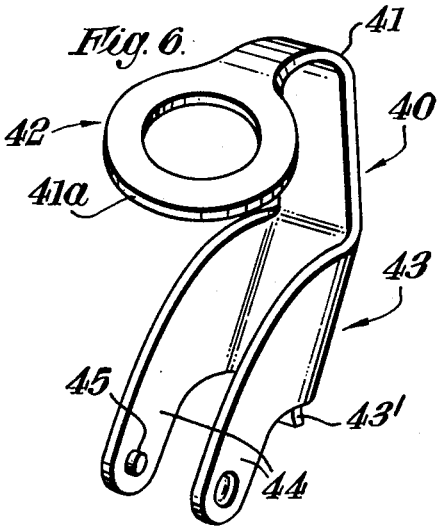
FIG. 6 illustrates a perspective view of the back part of an ear ornament clip in accordance with the invention.

With reference to FIG. 6, there is illustrated a back part 40 of the two-part ear ornament clip. Back part 40 has a first portion 41 which includes a face 42, the end portion 41*a* of which is adapted to be placed in contact with that surface of the lobe of the wearer's ear which is remote from the surface thereof against which the ornament is to be displayed. Back part 40 also comprises a second portion 43 which is integral with first portion 41 and which is constituted by substantially parallel legs 44. Each leg 44 has near the free end thereof a protuberance or pip 45 formed by upsetting, the pips 45 being coaxial and extending towards one another. The circle seen in FIG. 6 near the free end of the rightmost leg 44 is the depression or dimple formed in that face of the leg 44 when the pip 45 was upset.

Referring now to FIGS. 1 through 4, the front part 20 and the back part 40 are brought together to cause the coaxial pips 45 of back part 40 to snap into coaxial apertures 28 of front part 20. The front part 20 and back part 40 of the clip are each made of substantially springy material, and most preferably of stainless steel. A primary advantage of the invention, which is of importance to anyone having to assemble front part 20 and back part 40, is that their assembly is completed, for example, by simply moving the two parts together in such a manner that the centers of apertures 28 of front part 20 are directed towards the centers of pips 45 of back part 40 until pips 45 have snapped into apertures 28. Due to the shapes of front part 20 and back part 40, the possibility of improperly assembling the two parts is substantially reduced in comparison to the prior art construction depicted in FIGS. 7 and 8 wherein improper assembly of the two parts can easily occur due in part to the comparatively long distance from the edge of the front part to the pivot point.

Figure 1:
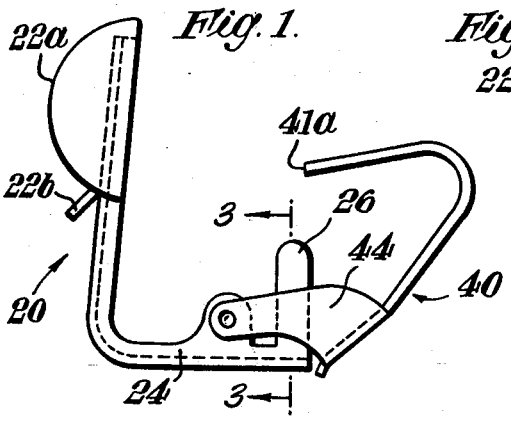
FIG. 1 depicts a side elevation view of an ear ornament clip according to the invention, shown in the fully open condition.
Figure 2:
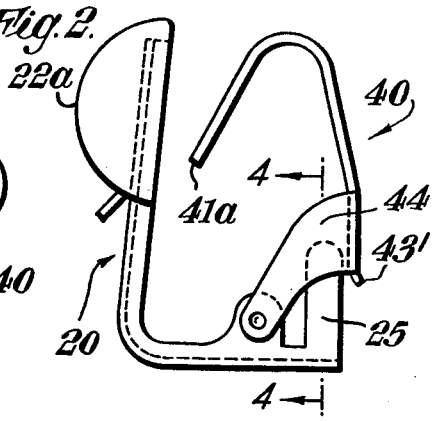
FIG. 2 illustrates a side elevation view of the clip of FIG. 1, shown in an ear lobe gripping condition.
Figure 3:
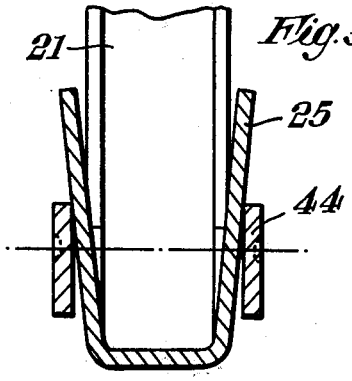
FIG. 3 is an enlarged view of the clip taken along line 3—3 of FIG. 1.
Figure 4:
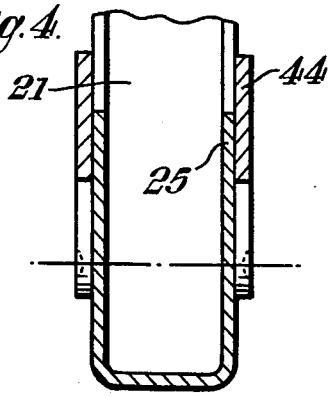
FIG. 4 is an enlarged view of the clip taken along line 4—4 of FIG. 2.

The clip illustrated in FIGS. 1 through 4 is identical in configuration to the disassembled clip shown in FIGS. 5 and 6, however, in FIGS. 1–4 the clip is shown provided with an added ornamental button 22*a*. The button 22*a* is secured to the face 22 of first portion 21 of front part 20 such as by passing suitable securing means through aperture 29. The button 22*a* can alternatively be either riveted, soldered, or spot welded to end 30. End 30 may be altered to provide for securing an ornament by an adhesive, or by heat (heated tabs on end 30 being pressed into an ornament made of a synthetic resin) and to provide for securing of a pearl bouton ornament. The button 22*a* shown in FIGS. 1 and 2 is provided with a downwardly projecting small eye 22*b* which enables the clip to be associated with a pendant decoration.

In FIG. 1, the front part 20 and back part 40 are shown in the fully open condition in which the inside surfaces of substantially parallel legs 44 are no longer in firm frictional engagement with the outer surfaces of the divergent resilient elements 25. This relative position between parallel legs 44 and divergent resilient elements 25 is more clearly depicted in FIG. 3. In this fully open condition of the clip, it can be seen that the free end 41*a* of first portion 41 of back part 40 is substantially spaced from and above the free ends 26 of resilient elements 25.

It should again be noted that the "fully open" condition of the clip (as shown in FIG. 1) is that relative position of front part 20 with respect to back part 40 in which the two parts are separated so as to either release the ear lobe or in preparation for applying the clip to the ear lobe, and that relative position of the two parts where they are frictionally engaged and able to maintain this position.

In this fully open condition of the clip, a woman will not need to make any such preliminary adjustment of back part 40 relative to front part 20 as was described above with reference to FIGS. 7 and 8, since the clip can be preset to the position shown in FIG. 1. All she will need to do is to pick up the clip and press front part 20 and back part 40 together to bring them into the lobe-gripping condition thereof which is illustrated in FIG. 2. Although the angle through which back part 40 needs to be moved relative to front part 20 is approximately 40°, as can be measured by comparing FIGS. 1 and 2, the inside surfaces of legs 44 contact the outside surfaces of divergent elements 25 at a very early stage, as compared to prior art of the angular movement of back part 40 about the pivotal axis provided by the interengaged pips 45 and apertures 28. Thus, the degree of friction which is ultimately necessary to maintain the clip parts in the relative positions thereof shown in FIG. 2 begins to be developed almost as soon as back part 40 is moved angularly relative to front part 20. The friction developed between legs 44 and divergent elements 25 increases as the elements are constrained to become less divergent, and reaches a degree in the FIG. 2 position of back part 40 which will maintain that setting of the clip parts. The frictional engagement between the outside surfaces of divergent elements 25 and the inside surfaces of legs 44 in the FIG. 2 position of back part 40 is clearly depicted in FIG. 4.

In the FIG. 2 condition of the clip, the entire ear ornament clip may be contained within a rectangle of approximately 9 mm by 13 mm. In general, the periphery of the clip in the FIG. 2 condition substantially defines a general box shape or rectangular shape.

It should be noted that the second portion 43 of back part 40 is further provided with a nib 43' disposed between the legs 44. The nib 43' will butt against the lower horizontal outside edge of second portion 24 of front part 20 when back part 40 is pivoted down completely, thus serving as a stop member to restrict any further downward pivotal movement of back part 40 with respect to front part 20.

Figure 7:
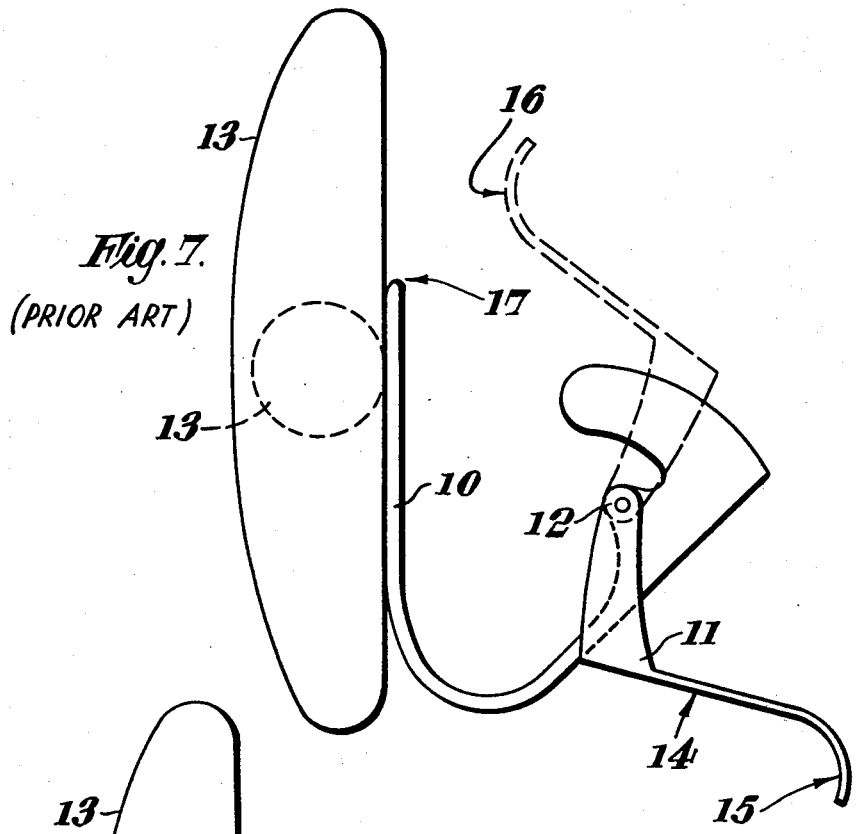
Fig. 7. (PRIOR ART)
FIGS. 7 and 8 illustrate different conditions of a prior art ear ornament clip as discussed hereinabove.
Figure 8:
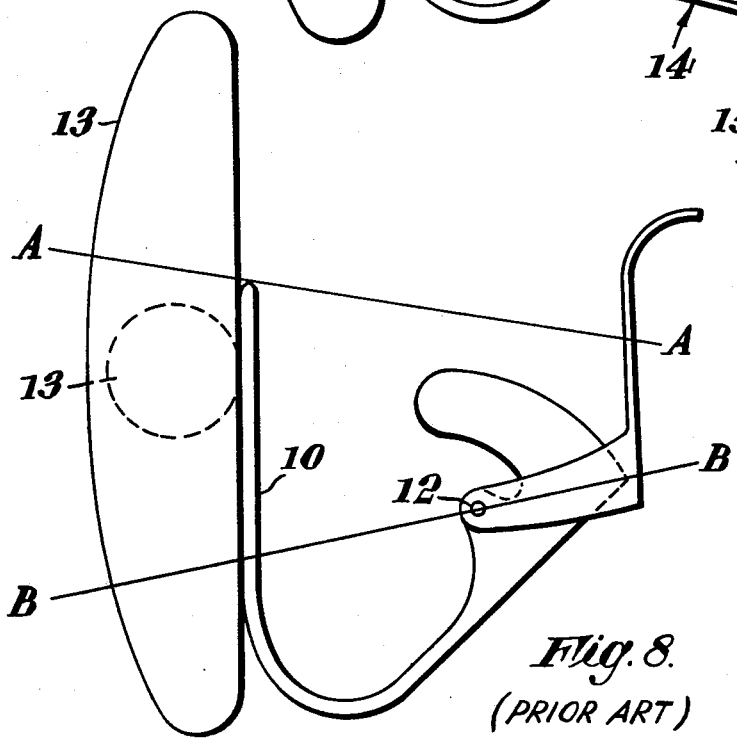
Fig. 8. (PRIOR ART)

A highly important advantage afforded by the present invention which is of importance to the user can be appreciated from a comparison of FIGS. 2 and 7. In FIG. 7, the back part 11 is drawn in dotted lines in approximately the position in which it occupies when the lobe is gripped between front part 10 and back part 11. However, it will be seen that surface 16 of the curved end part 15 of back part 11 is not in horizontal alignment with the top edge 17 of front part 10. This configuration of the prior art clip does not give rise to any particular awkwardness when the ornament is large (as drawn in full line, marked 13) but could give rise to awkwardness and possible discomfort when the ornament is small (as shown in dotted line, marked 13). In FIG. 2, it will be seen that with the clip according to the present invention the two portions which will actually grip the lobe between them are in horizontal alignment, and such is clearly the optimum arrangement because the grip does not depend for effectiveness and comfort on the size of the ornament.

In particular, in FIG. 2 it can be seen that, due to the fact that first portion 41 of back part 40 is substantially curved at its uppermost portion to form a general U-shape with diverging legs, the free end **41*a* of first portion 41 will comprise the actual ear lobe contacting portion of back part 40. The remainder of face 42 of first portion 41 will diverge slightly away from the wearer's ear lobe. With this configuration of first portion 41, it is a simple manner, for example, for the user to remove the clip from an ear lobe gripping position (FIG. 2) by merely inserting her finger tip or fingernail into the slight space between the face 42 and her ear lobe and merely applying a pulling force to pivot the back part away from her ear lobe. Back part 40 may also be pulled rearwardly away from front part 20 by grasping the divergent leg of the U-shaped first portion 41** which is most remote from the user's ear lobe.

The resilient elements 25 can either be inherently resilient as a result of the material chosen for manufacture of the clip parts, or can be given the necessary springiness by placing elastic means between the elements if the clip parts are made of a precious metal. Such elastic means and their design and mode of use in a precious metal ear ornament clip are described and illustrated in United Kingdom patent Specification No. 1,286,245 and U.S. Pat. No. 3,654,774. Consequently, any reference to "resilient elements" in the appended claims is to be interpreted as including elements to which the necessary springiness has been imparted by such elastic means.

Although there have been described what are at present considered to be the preferred embodiments of the invention, it will be understood that various modifications may be made therein without departing from the spirit or essential characteristics thereof. The present embodiments are therefore to be considered in all respects as illustrative, and not restrictive. The scope of the invention is indicated by the appended claims rather than by the foregoing description.

I claim:

1. An ear ornament clip comprising:

a front part and back part, said front and back parts being so connected to one another as to permit angular movement of said parts relative to each other in order to grip or release a wearer's ear lobe;

said front part having a first portion of which a first face is adapted to carry the ornament and of which a second face is adapted to be placed in contact with that first surface of the wearer's ear lobe against which said ornament is to be displayed;

said front part having a second portion integral with said first portion and including elements which are so joined to one another at corresponding one ends thereof as to form resilient elements substantially in the form of a V, the corresponding other and free ends of said elements extending substantially parallel to said first portion of said front part;

said back part having a first portion which includes a third face of which at least a portion thereof is adapted to be placed in contact with that second surface of the wearer's ear lobe which is remote from said surface thereof against which said ornament is to be displayed;

said third face and said second face forming an acute angle with each other when placed in contact with said first and second surfaces;

said back part having a second portion which is integral with said first portion thereof and which comprises substantially parallel legs;

said front part having first means disposed near said resilient elements and said back part having second means disposed near the free ends of said legs, said first and second means cooperating to form a pivotal connection between said front and back parts;

relative angular movement of said front and back parts to a condition in which an ear lobe becomes gripped between said first portion of said front part and said first portion of said back part causing the lobe-gripping portions of said front and back parts of said clip to become disposed substantially directly opposite to each other, and also causing the inside surface of said legs to frictionally slide along the outside surfaces of said resilient elements towards said free ends of said resilient elements and to force said resilient elements together to establish and maintain the desired lobe-gripping condition of said front and back parts;

said first portion of said back part being substantially U-shaped with diverging legs;

said U-shaped first portion of said back part including a first diverging leg having a free end and a second diverging leg which is integral with said second portion of said back part; and said free end of said first diverging leg comprising said lobe contacting portion of said first portion of said back part, the remainder of said first diverging leg being configured such that, when in place against the ear lobe, said third face will diverge sufficiently from the lobe to be accessible to the wearer for manual application of a pulling force thereagainst to remove the ear ornament clip.

2. An ear ornament clip according to claim 1, wherein:

said ear ornament clip, including said front part and said back part, is fabricated of stainless steel.

3. An ear ornament clip according to claim 1, wherein:

in the fully open condition of said ear ornament clip, that end or end portion of said back part which is remote from said free ends of said legs is substantially spaced from said free ends of said resilient elements of said second portion of said front part.

4. An ear ornament clip according to claim 1, wherein:

said first portion of said front part includes an enlarged free end having said ornament-carrying face and said ear lobe contacting face, said enlarged free end having provided therein an aperture; and said aperture is adapted to receive means for securing an ornament to said ornament-carrying face.

5. An ear ornament clip according to claim 1, wherein:

when said front and back parts are disposed in said lobe-gripping conditions, said front and back parts define a substantially box-shaped peripheral configuration of said ear ornament clip.

* * * * *